United States Patent [19]

Schmidt et al.

[11] Patent Number: 4,566,287

[45] Date of Patent: Jan. 28, 1986

[54] POST MIX DISPENSING MACHINE

[76] Inventors: Richard J. Schmidt, 695 Trinity Ct., Longwood, Fla. 32750; Ronald R. Schmidt, 1416 Hartley Ave., Deltona, Fla. 32725; Walter E. Schmidt, 4 Stonegate N., Longwood, Fla. 32779; Patrick J. Schmidt, 1710 Twin Oaks St., Deltona, Fla. 32725

[21] Appl. No.: 558,294

[22] Filed: Dec. 5, 1983

[51] Int. Cl.[4] ..... F25D 17/02; B67D 5/56

[52] U.S. Cl. ..... 62/188; 62/390; 141/174; 222/129.3

[58] Field of Search ..... 141/107, 174; 62/390–392, 394, 188; 222/129.3, 129.4, 132, 133, 136

[56] References Cited

U.S. PATENT DOCUMENTS

| | | | |
|---|---|---|---|
| 2,073,779 | 3/1937 | Bramsen | 366/162 |
| 2,502,603 | 4/1950 | Tanner | 225/21 |
| 2,755,006 | 7/1956 | Small et al. | 141/174 X |
| 2,755,979 | 7/1956 | Lawson et al. | 141/174 X |
| 2,774,393 | 12/1956 | Swan | 141/18 |
| 2,785,540 | 3/1957 | Bauerlein | 62/390 X |
| 2,817,935 | 12/1957 | Fischer et al. | 53/123 |
| 2,852,043 | 9/1958 | Cooper | 141/174 X |
| 2,879,811 | 3/1959 | Parraga | 141/174 X |
| 2,894,377 | 7/1959 | Shikles, Jr. et al. | 62/390 X |
| 2,934,243 | 4/1960 | Metzger | 141/361 X |
| 2,967,644 | 1/1961 | Barber et al. | 141/174 X |
| 3,051,456 | 8/1962 | Clarke et al. | 366/162 |
| 3,056,273 | 10/1962 | Cornelius | 62/393 |
| 3,097,670 | 7/1963 | Berman | 141/361 X |
| 3,108,718 | 10/1963 | Seener | 62/390 X |
| 3,209,797 | 10/1965 | Marchetti | 141/362 |
| 3,359,754 | 12/1967 | Cornelius | 62/389 |
| 3,382,897 | 5/1968 | Skiera et al. | 141/107 |
| 3,568,887 | 3/1971 | Jacobs | 222/129.4 |
| 3,898,861 | 8/1975 | McMillin | 62/177 |
| 4,172,669 | 10/1979 | Edelbach | 222/129.4 X |
| 4,218,014 | 8/1980 | Tracy | 222/144.5 |
| 4,316,557 | 2/1982 | Benoun et al. | 222/129.1 |
| 4,356,937 | 11/1982 | Simon et al. | 222/129.2 |
| 4,493,441 | 1/1985 | Sedam et al. | 62/390 X |

*Primary Examiner*—William E. Wayner
*Attorney, Agent, or Firm*—Julian C. Renfro

[57] ABSTRACT

A machine for dispensing a freshly mixed cup of juice or other beverage made from concentrate mixed with water immediately prior to the dispensing, comprising a generally U-shaped water reservoir, the water in which is kept at an essentially constant level by means of a proximity switch interacting with a solenoid valve located in the principal water supply. Coils of a refrigerant unit are disposed in the reservoir to chill the water to a temperature above the freezing point, and one or more concentrate tanks are located between the arms of the U-shaped reservoir, so that the concentrate will be chilled to, and maintained at, a desired temperature. Modular pump units are utilized for pumping concentrate into a mixing chamber, with a power driven impeller utilized in the mixing chamber to effect a mixing of concentrate with a suitable quantity of water from the reservoir. Down time of the machine is minimized by the modular pump units being quickly replaceable in case of malfunction, with the refrigeration unit used in the machine likewise being modularized to permit rapid replacement.

32 Claims, 9 Drawing Figures

POST MIX DISPENSING MACHINE

DESCRIPTION OF THE PRIOR ART

In the past a number of so-called "Post-Mix" beverage dispensing machines have been marketed, but these machines have suffered from a number of serious problems, a chief one being an inability to dispense a consistently homogeneous glass of juice.

In machines of the Post-Mix type, a quantity of frozen concentrate such as of orange, lemon, tea or the like was dispensed from chilled tanks or vessels in the machine, and mixed with a quantity of refrigerated city water at such time as a dispensing lever was pressed. In some instances, the dispensed glass of juice was watery at the top, but viscous at the bottom, this resulting from a poor mixing of the concentrate with water. In other instances, an overly thin, or an overly concentrated glass of juice was dispensed, this frequently resulting from a variation in water pressure, perhaps the consequence of a nearby dishwasher suddenly cycling on.

Managers of restaurants and other eating places where post-mix machines have been installed almost always receive a number of complaints, involving for example the difficulty experienced by short waitresses trying to pour concentrate into the containers of a top loading machine; or the considerable drudgery involved in cleaning the machines; the instances in which dirt and even vermin have entered such machines; and the frequent drippage from such machines onto counters and floors.

Even more significant than the foregoing are the efforts that must be put forth by service and repair personnel concerned with maintaining the post-mix machines of the prior art in proper operating condition. As an example, most of the post-mix machines presently on the market utilize a "split" refrigeration system, in which a refrigeration solenoid serves to divide the flow of freon between the refrigeration of water to be used in preparing the beverage, and the refrigeration associated with the concentrate, to keep it from spoiling. Common difficulties involve solenoid malfunction, evaporator leaks, defective thermostats, and excessive loads on the compressor. Any such difficulties occuring in the refrigeration components necessitated the removal of the complete machine from the premises, and frequently required the substitution of another machine by the repairman. The disruption to the restaurant was often significant, and the expense for the time and efforts of the repairman was considerable, particularly in view of the financial outlay he must make in order to have a number of replacement machines on hand.

Even though many of the instances of component failure in the refrigeration systems of the prior art were relatively minor, the refrigeration systems were almost invariably hard to get at, and would necessitate an inordinate amount of inconvenience if component substitution was attempted at the restaurant.

Another trouble spot involved the water solenoids, which would not function properly in the event of any foreign particle lodging inside the solenoid. One particular manufacturer utilizes four water solenoids, which are located on the backside of his machine. To attempt on-site repair, the machine must be turned around, which quite obviously consumes a considerable amount of counter space. Frequently the screws holding the access panel for the solenoids were corroded, greatly complicating the replacement of each solenoid. Also, certain manufacturers do not provide water cutoff valves on their machines, and this necessitates the turning off of water to at least a portion of the building.

One particularly dramatic event associated with the plumbing of the prior art post-mix machines involves the flush solenoid, which connects by a silicon rubber tube to the concentrate tank check valve. This check valve functions to prevent water from flowing into the concentrate tank during the flush phase. Often the flush solenoid will leak, for any of several reasons, and this will lead to a buildup of pressure in the concentrate tube. This tube will gradually become larger and larger from overpressure, and may suddenly rupture, with very undesirable results.

Still other problems occured as a result of the spillage and drippage that invariably accompanied the use of the post-mix machines, and for example, the small lights designed to indicate when some part of the machine was in need of attention failed to operate properly. Also, many parts and components corrode, electrical connections become unreliable, and electrolytic action takes place. Many times the hinges of the dispensing levers become contaminated from spilled concentrate, and consequently these levers fail to shut off quickly when released, thus causing an overfilling of the glass or cup.

When a thorough cleaning of a prior art machine was in order, the workmen necessarily had to rely upon proper operation of certain solenoid valves, that would cause a cleansing solution, and/or a rinse solution to flow through the piping and chambers of the machines. However, often these valves failed to open properly, or if opened, they failed to reclose properly. Problems of this type were often a direct result of spillage around the machine.

Spillage onto the pumps utilized for pumping concentrate into the chamber where mixing of city water with concentrate took place, frequently caused non reliable operation of the machine, and the covers utilized on the upper surface of top loading machines were often easily dislodged, which meant that dirt and insects could frequently be found in the tanks of concentrate. Also, hot coffee pots were occasionally put on these covers which, being plastic, frequently became distorted and thus became impossible to utilize for complete closure.

It was in an effort to provide satisfactory solutions to problems of these and other types that the present considerably improved post-mix dispensing machine was evolved.

SUMMARY OF THIS INVENTION

In accordance with this invention we have provided a post-mix juice dispenser that has been carefully engineered to meet the needs of the restaurant owner, the waiters and waitresses, the maintenance men, and the organization concerned with keeping the machines properly repaired on a quick turn around basis.

First of all, we have evolved a post-mix machine in which the water utilized for mixing with the concentrate flows out of a gravity water supply, thus removing the problems associated with trying to mix concentrate with water at a fluctuating pressure. We prefer to utilize a form of proximity switch in the water supply tank of the machine, such that the automatic refilling of the tank or reservoir by means of a city water connection will maintain the necessary water head pressure.

Advantageously, the water supply tank or reservoir we utilize is generally U-shaped when viewed from above, with the arms of the U extending generally forwardly, toward the front of the machine. The arms of the machine are spaced far enough apart such that at least one, but preferably two or three tanks of concentrate can be received therebetween. Because these concentrate tanks are therefore approximately in the front of the machine, it is but a simple manner for even a very short waitress to ascertain when refilling is necessary. The arrangement we use involves a single tightly fitting concentrate access panel, which may be fitted with a lock, thus assuring that theft of the concentrate and entry of dirt and bugs are effectively prevented.

In addition to the U-shaped reservoir containing water, it also contains the evaporator coils associated with the refrigeration system, such that the water in the tank is kept quite cold, but above the freezing point. Likewise, the concentrate tanks contacted by the arms of the reservoir are kept at a preferred low temperature.

As a result of the preferred refrigeration arrangement we use, the compressor, condenser and evaporator coils are all packaged in what may be regarded as a modular unit, which unit may be readily removed at the time that any malfunction is found to exist in the refrigeration system. One particular cause of frequent malfunction in prior art machines was found to be in the placement in certain of the evaporator coils, which were utilized in surrounding relation about the concentrate tanks. The frequent removal of these tanks for cleaning, and the subsequent re-insertion thereof into the coil array often brought about the wearing of a hole in the evaporator coils, and the consequent loss of freon (or other refrigerant) therefrom.

In contrast, the evaporator coils used in our novel U-shaped water reservoir are effectively protected from damage, due to their placement in the water reservoir, and when a problem does arise with the refrigeration system, the entire refrigeration system including the evaporator coils may be removed, and a new or rebuilt refrigeration unit quickly substituted therefor. Advantageously, such a removal of the refrigeration system can take place in the restaurant or in a nearby location, the replacement unit readily substituted, and the same post-mix machine returned to service a short while later. This arrangement is a great boon to the maintenance and repair people, who no longer have to maintain on hand a number of complete post-mix machines, for the standby refrigeration units necessary to keep on hand represent but a fraction of the dollar outlay involved if complete post-mix units must be kept available.

In the interests of effectiveness, cleanliness, and simplicity, we utilize a plurality of pump modules, one associated with each concentrate tank. Each pump module utilizes an electric motor which preferably has both ends of the motor shaft available, with one end of the shaft serving to drive the beater or impeller contained in the respective mixing chamber, and the other motor shaft end being arranged to drive, preferably through a speed reduction unit, the pump that serves to deliver concentrate to that mixing chamber. We prefer to use so-called peristaltic pumps for delivering concentrate to the respective mixing chambers.

The power operated mixing chamber we use for concentrate and water is a substantial advance over the mixing chambers of the prior art, where the swirl of entering water was often relied upon to mix the concentrate in the proper consistency, but often the mixing was much less than satisfactory.

As is obvious, by the use of modular units in our machine, we can easily replace a malfunctioning pump, with the machine remaining in the restaurant, for very little dismantling of the machine is involved in removal of the defective pump module, and replacing it with a new or rebuilt one.

Rather than the cleaning of our machine at the end of a working day being a very onerous task, it is merely necessary to successively lift each pump intake tube from the respective concentrate receptacle, and separately place each such tube in a cleansing or sanitizing solution. In such an instance, the operator closes the first electric switch to cause the corresponding pump module to operate. Accordingly, the cleansing solution passes through the pump as well as the respective mixing chamber, with the operator being able to observe when the cleansing fluid runs clear. When such point has been reached, the pump intake tube is placed in a basin of water such that a proper amount of rinsing of that unit can be effected. Thereafter, the other units are cleansed and rinsed in a like manner.

It is therefore a primary object of our invention to provide a post-mix machine that will deliver a consistently homogenous cup or glass of juice.

It is another object of our invention to provide a post-mix beverage dispenser made up of modular components, such that defective componets can be replaced on-site, with machine down time minimized.

It is still another object of this invention to provide a constant-head water supply arrangement for a post-mix beverage dispenser such that fluctuations in city water pressure will not cause juice to be dispensed at an improper consistency.

It is yet another object of our invention to provide a thorough mixing of water with concentrate in the mixing chambers of a post-mix machine, using power from the same motor as is used for pumping concentrate.

It is yet still another object of our invention to provide a service oriented post-mix machine, utilizing a minimum number of valves, which machine may readily be cleaned and/or serviced without moving it away from its counter top location in a restaurant or the like.

It is yet still another object of our invention to provide a novel U-shaped tank for supplying water in proper quantities to the mixing chambers of a post-mix beverage dispenser, with the refrigeration arrangement used to chill the water in the tank also serving to maintain the concentrate tanks disposed between the arms of the U-shaped tank at a desired low temperature.

These and other objects, features and advantages will become more apparent as the description proceeds.

DETAILED DESCRIPTION

Figure 1:
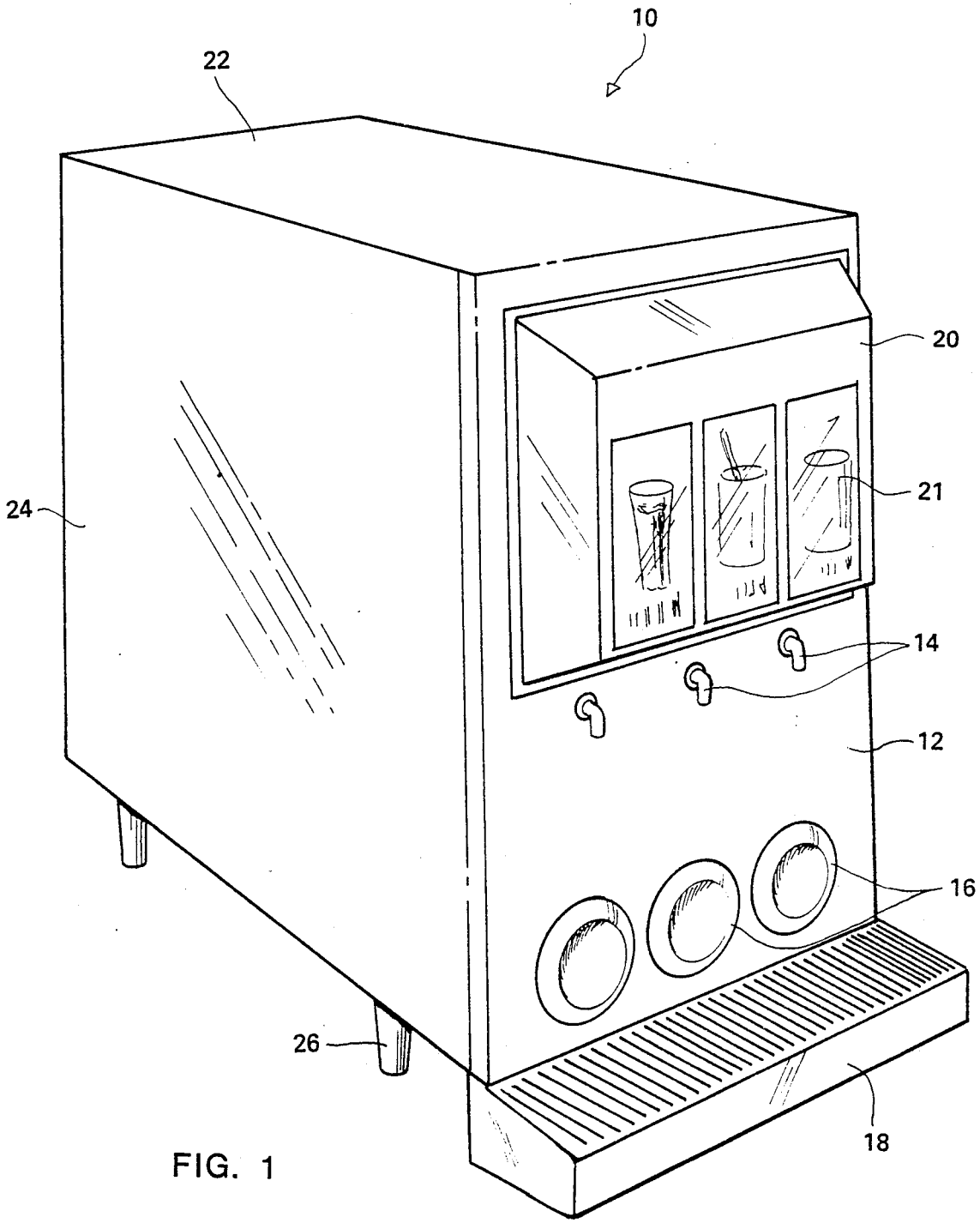
FIG. 1 is an overall perspective view showing the front exterior of our novel post mix beverage dispensing machine.

Turning first to FIG. 1, we have there shown a perspective view of the exterior of our novel post-mix beverage dispensing machine 10, from which a user can cause a selected, freshly mixed beverage to be dispensed into a cup or glass. The front panel 12, which for example may be of stainless steel, contains a plurality of dispensing nozzles 14, three such nozzles being shown in this embodiment. However, either a larger or a smaller number of dispensing nozzles may be used, depending upon how many beverages are to be available in this machine.

Dispensing buttons or pads 16 are provided on the front panel below the respective dispensing nozzles, and it is by the pressing of one of these pads that the user actuates an electric switch of the type depicted in FIGS. 2 and 6, that causes the selected beverage to be dispensed. Although we may for convenience hereinafter refer only to the dispensing of "juice", it is to be understood that we also intend to include other beverages in that terminology, including iced tea, for example. A drip tray 18 is provided, which can be used to support the cup or glass to receive the beverage, and even more importantly, to serve as a removable receptacle for overflow, or for drippage from dispensing.

Above the dispensing nozzles 14 is a front display panel 20, such as of plastic, which contains a plurality of decorative displays 21, which served to identify to the user, the particular beverages that are available at a given time from our machine. The front display panel preferably protrudes outwardly beyond the plane of the front panel 12 so that the concentrate tanks, to be seen in FIG. 2, can be of a desired length in a front-to-back sense. A key lock (not visible in FIG. 1) is preferably provided on the front underside of the display panel 20, and it is only by having the appropriate key that someone may gain access to the interior of our machine, as well as access to the main service on-off switch 41, visible in FIGS. 3 and 8.

Closure of our novel machine as depicted in FIG. 1 is further accomplished by the provision of a top panel 22, a side panel 24, and other suitable panels on the remaining external portions of the machine. Preferably the panels are of stainless steel, aluminum, or other non-corrosive material, and appropriate ones of said panels have interlocking edges so that vermin are excluded, and so that unauthorized access to the concentrate tanks largely can be prevented.

Figure 2:
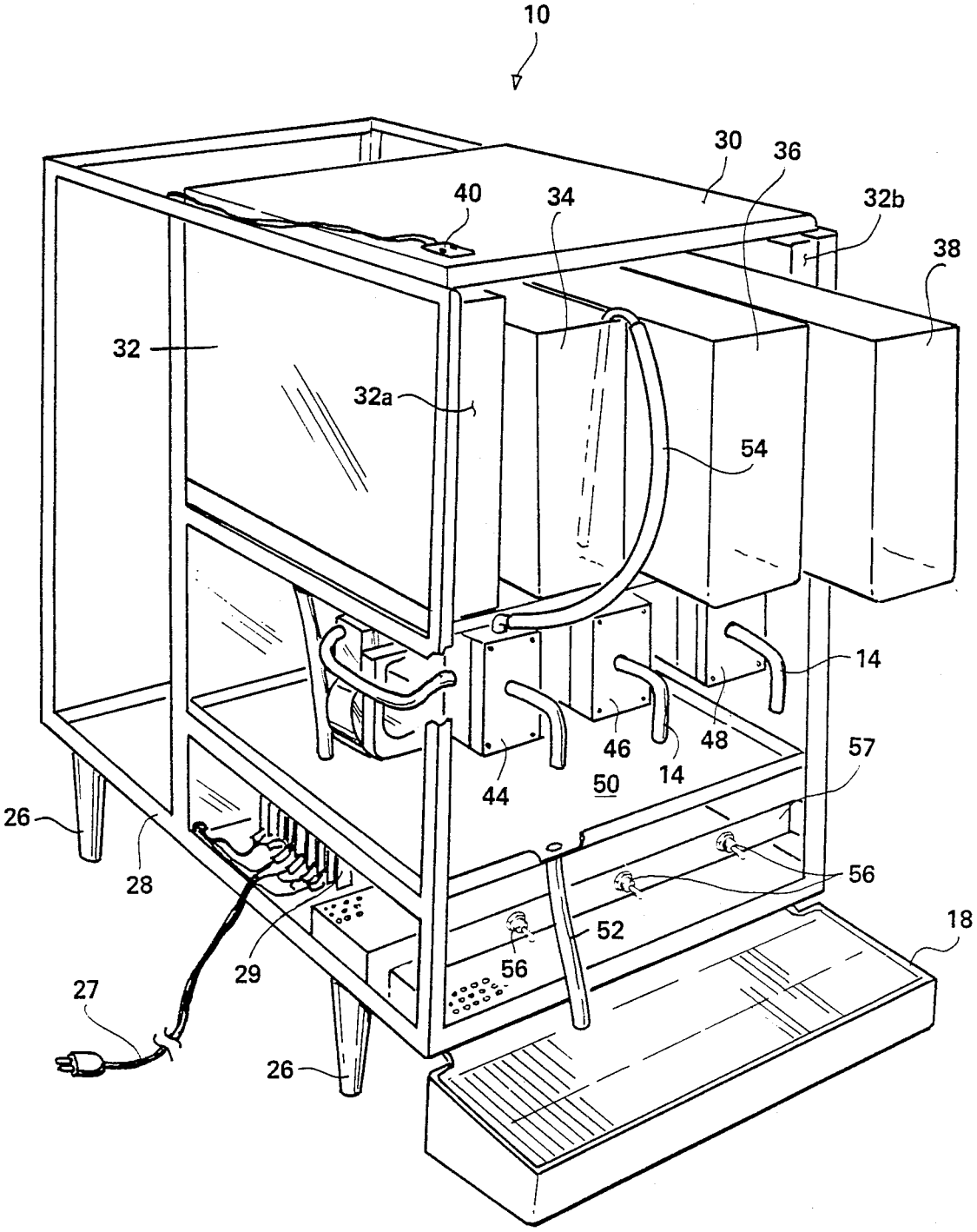
FIG. 2 is another perspective view, but with exterior panels being removed in order to reveal internal construction.

Turning now to FIG. 2, it will there be seen that we have shown the external panels removed, so that the frame 28 is revealed. Many of the components of the frame are of L-shaped cross section, and such components are preferably of aluminum or other non-corrosive material welded together. Legs 26 for supporting the frame 28 are also shown in this figure.

Removal of the top exterior panel 22 makes visible the water tank cover 30, the underside of which is provided with insulating/gasketing material, such that the cover fits closely atop the water tank or reservoir 32. However, a suitable cutout on the rear of the cover 30 permits the entry and exit of tubing associated with the supply of refrigerant to the evaporator coil 62, which is revealed by FIG. 3 to be a generally U-shaped array 62. On the underside of cover 30 is mounted a proximity switch 40, which switch we consider to be a vast improvement over the float switches previously used by certain manufacturers for controlling water level in water supply tanks.

Figure 7:
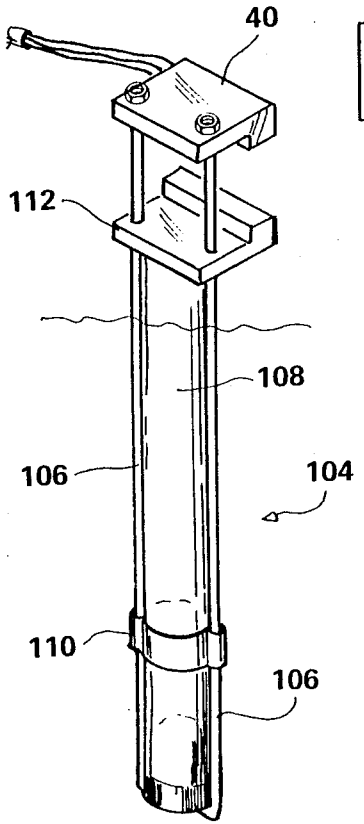
FIG. 7 is a view of the float system we use within the U-shaped water reservoir, that functions to actuate the proximity switch when the desired water level is reached.

The proximity switch we prefer to use is a magnetically actuated switch, that is normally closed, and that is affixed to the water tank cover 30. The magnetic actuator is located on a float inside the water tank, and FIG. 7 shows a preferred form of the float device 104. As the water level rises, the magnetic actuator is lifted by the float, such that it approaches the switch. Eventually, the magnetic actuator causes the switch to open the circuit of solenoid 98 (shown in FIG. 8), such that it shuts off the water supply to tank 32, thus to prevent overfilling. We prefer to use a Hamlin #5802 switch, and a Hamlin #5701 magnetic actuator.

One of the particularly important components of our machine is the U-shaped water tank 32, that is supported in an upper part of the machine by suitable frame components, not visible in FIG. 2. As seen in this figure, but in greater detail in FIG. 3, the U-shaped tank 32 has left and right arms 32*a* and 32*b*, and these along with shelf portion 42 of the tank form a suitable enclosure and support for the concentrate tanks 34, and 36 and 38, visible in FIG. 2.

The ready removability of the concentrate tanks for refilling is represented by the positioning of tanks 36 and 38, which in FIG. 2 have been partially moved forwardly. However, it is to be understood that tank 34 is in the normal, operative position. Directly below the tanks 34, 36 and 38 are the respective pump modules 44, 46, and 48 associated with these tanks. The end of concentrate pickup tube 54 is revealed in FIG. 2 to be located in concentrate tank 34, such that by operation of the pump module 44, concentrate can be pulled into the mixing chamber of this module, and thoroughly mixed in the right proportion with chilled water, so that the resulting beverage can then be dispensed from the dispensing nozzle 14 associated with module 44. This phase of our invention will be discussed at length hereinafter. It is to be understood that concentrate pickup tubes are also operatively associated with tanks 36 and 38.

Also in FIG. 2, a condensate pan 50 is disposed directly beneath the three pump modules and the concentrate tanks, so that any condensate or spilled concentrate will be carried to the condensate tube 52, which leads into the drip tray 18.

Additionally visible in FIG. 2 are a plurality of dispensing switches 56, which are mounted on an elongate mounting plate 57. It is to be understood that the three electric switches 56 are push button switches, and they are associated with and disposed directly behind the dispensing pads 16 shown in FIG. 1. It is by operation of the respective switches that the appropriate beverage is dispensed at a given moment. The motor of the pump module runs, and the respective water solenoid remains open, for the length of time a selected switch 56 is held closed. The running of the motor causes concentrate to be pumped, and an impeller located in a mixing chamber to be driven in rotation, as will hereinafter be explained.

FIG. 2 also reveals a power cord 27 attached to a terminal board 29, such that 110 volts A.C. can be supplied to the electrical components of our machine. We provide an electrical schematic in our FIG. 8, the details of which will be discussed hereinafter.

Figure 3:
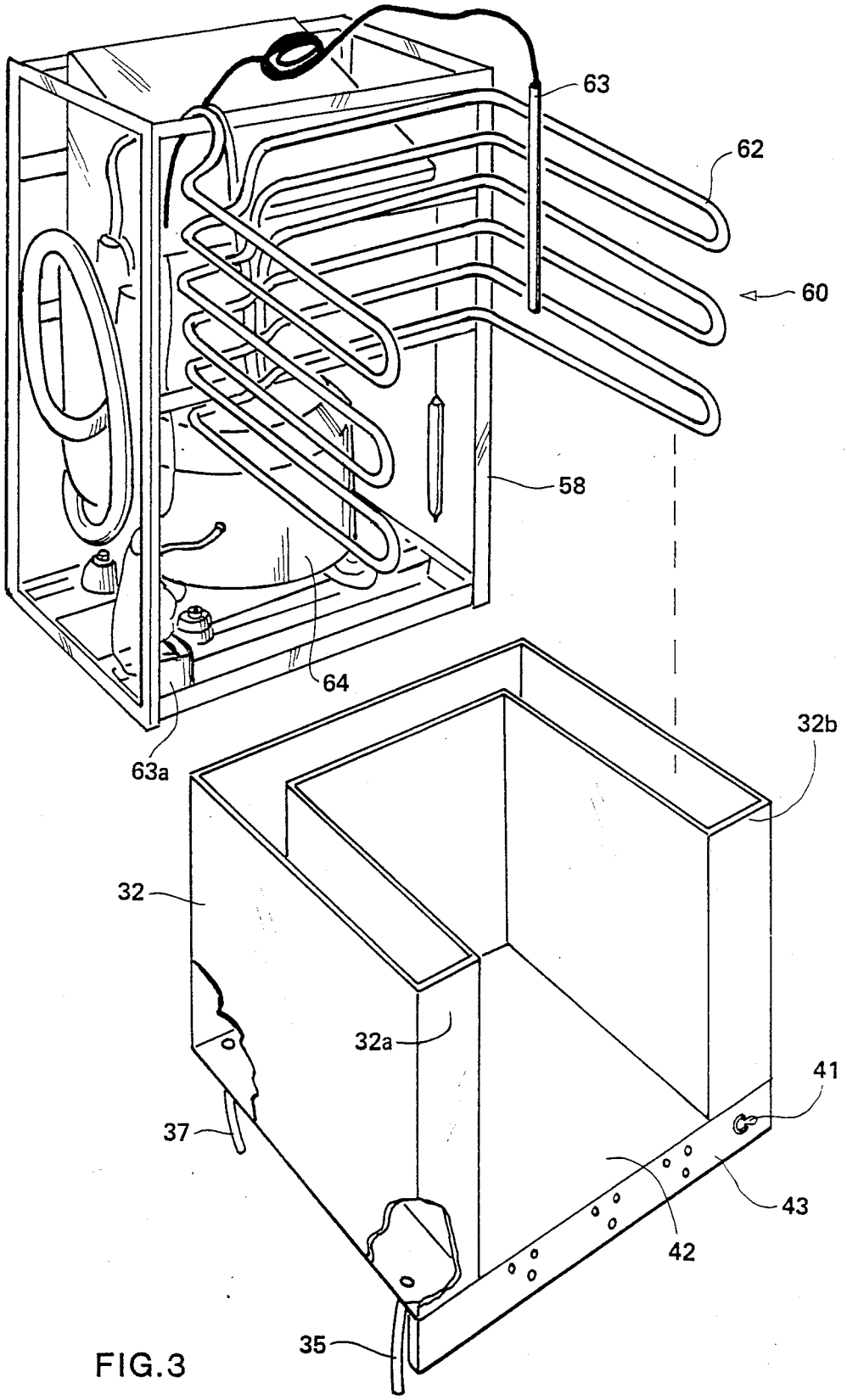
FIG. 3 is a perspective view with our U-shaped water supply tank isolated from the rest of the machine, and with the U-shaped coils and the rest of the refrigeration device shown in exploded relation thereto.

Referring to FIG. 3, the U-shaped water tank 32 is revealed in considerable detail, and this tank may be made of stainless steel, fibreglass, or other appropriate material. In this showing, the upper cover is removed in order to reveal that the evaporator coils 62 of our modular refrigeration unit 60 are also of U-shaped configuration, such that they can be readily accomodated inside the water tank. As is obvious, the evaporator coils 62 extend into substantially all portions of the tank 32, and serve to chill the water in the tank to a suitable low temperature above the freezing point. Because the concentrate tanks 34, 36 and 38 can be closely accomodated between the arms 32*a* and 32*b* of the water tank, and supported on the shelf 42, the contents of these three tanks can also be refrigerated to a suitable low temperature. As is obvious, the evaporator coils are isolated from factors likely to cause a puncturing thereof.

One cutaway portion of tank 32 in FIG. 3 reveals a water inlet pipe 35 by means of which city water (or well water) may be supplied to tank 32 under control of the proximity switch 40, and another cutaway portion reveals one of three water dispensing pipes 37, with one of these pipes connected so as to supply by gravity, chilled water to each pump module. The pump modules will be discussed in detail shortly.

FIG. 3 reveals that our modular refrigeration unit 60 is supported by a frame 58 that is independent from, but supported by, the frame 28 of the machine. Compressor 64 serves in a well known manner to bring about a circulation of freon (or other suitable refrigerant) through the condenser and evaporator coils of the machine. In view of the packaging of the refrigeration components into a module, the entire refrigeration system can be readily removed from the dispensing machine in the event of a malfunction, and then quickly replaced with a new or rebuilt unit. This arrangement is an important improvement over the prior art, which almost exclusively utilized "split cycle" refrigeration devices, which required a great deal of time to service or to replace.

As previously pointed out, the evaporator coils 62 being in a U-shaped configuration makes them removable from the water tank 32 at the time of needed substitution of refrigeration units. Also revealed in FIG. 3 is the temperature sensing capillary tube 63 that monitors the temperature of the water in the tank 32, via a thermostat 63*a*, to which it is connected. The thermostat directly controls when the compressor 64 runs.

It is to be noted in FIG. 3 that we may utilize a front support plate 43 on the front lower portion of the tank 32, which may be secured to the front edge of the shelf 42 between the arms of the U-shaped tank. This front support plate 43 is not illustrated in FIG. 2 for reasons of clarity. Provided in appropriate locations in the plate 43 are three spaced pairs of holes, so that access to the Brix adjustment screws of each module is conveniently possible. The single hole below each pair of holes in the plate 43 is of a size to accommodate the dispensing nozzles 14 of the three modules.

Figure 8:
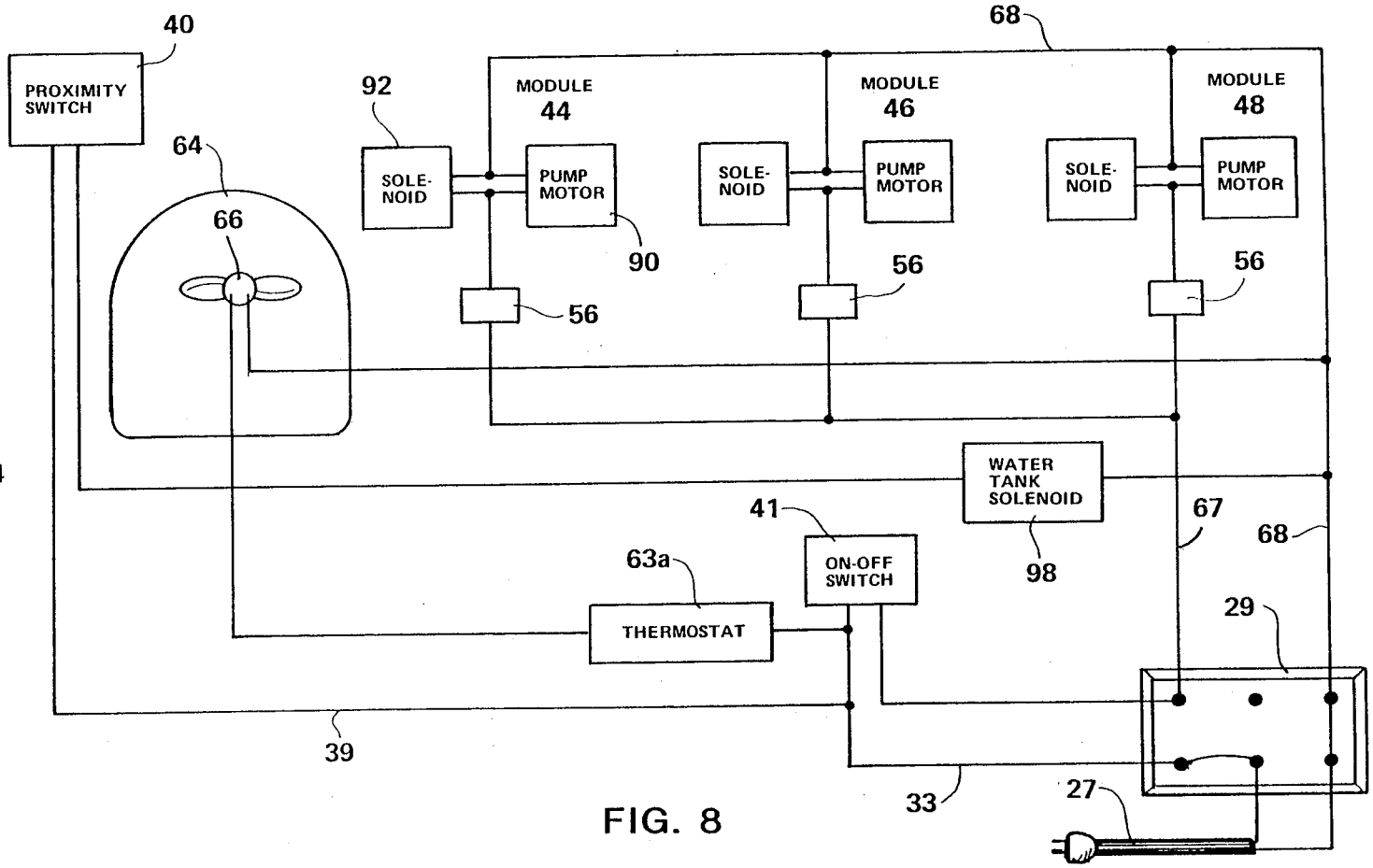
FIG. 8 is an electrical schematic of a preferred circuit concerned with the operation of our machine.

A cooling fan 66, shown in FIG. 8, runs the entire time that the compressor 64 is operating, and such fan serves to remove heat from the condenser. In doing so, the fan draws air upwardly through holes 102 in the bottom plate of the machine; see FIG. 6. We utilize quick disconnects in order that electrical power can be readily removed from the refrigeration module at such time as replacement becomes necessary. Then, by the reconnection of the quick disconnects, electrical power can be quickly provided to the replacement unit. Because of our advantageous use of the modular refrigeration unit, our post-mix drink machine is rarely out of service more than one hour from the time that a service man begins his work on the machine.

Figure 4:
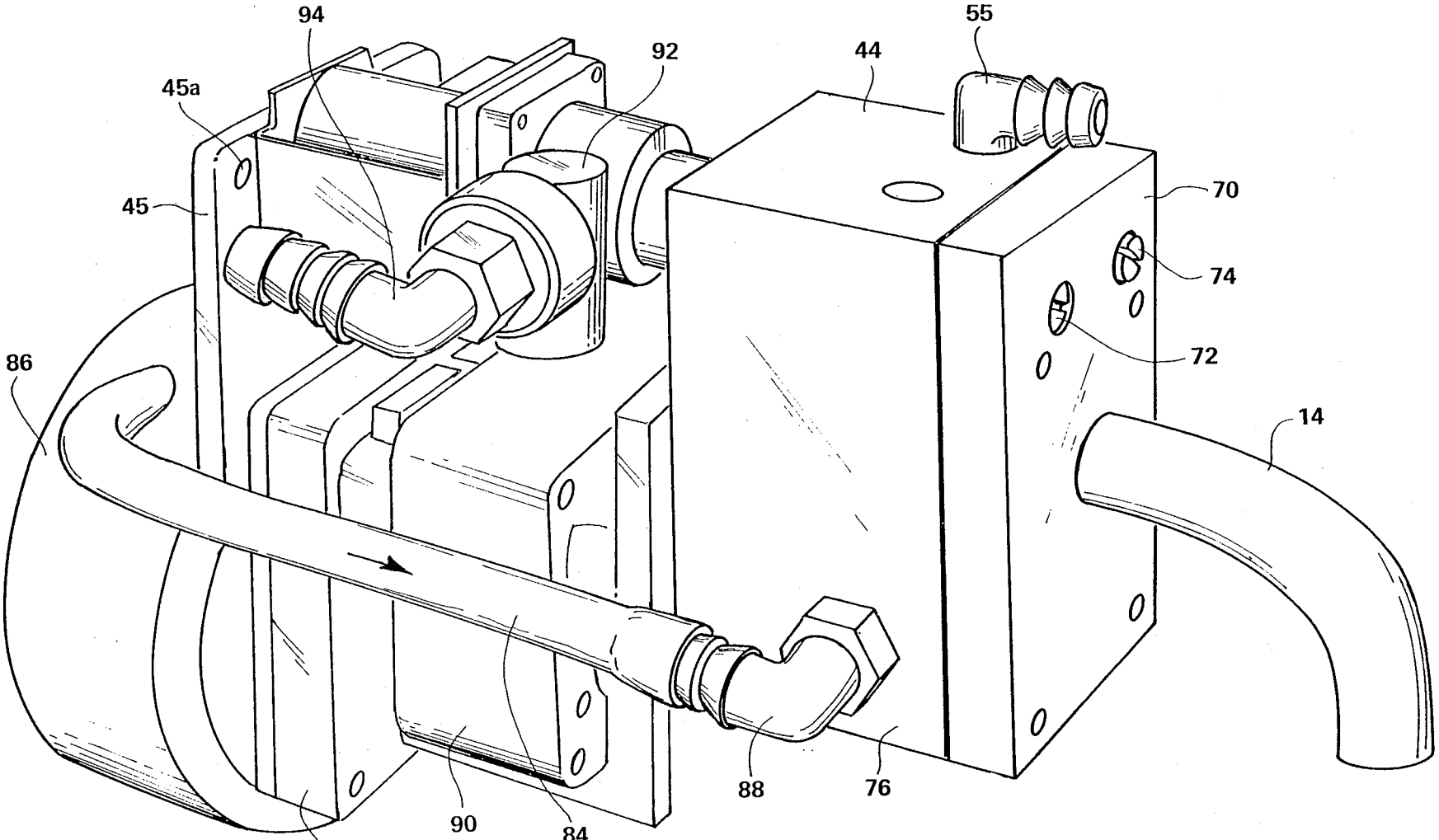
FIG. 4 is a view to a substantially larger scale of a preferred form of pump module, containing a pump motor functioning to pump concentrate to a mixing chamber, and also to power an impeller in the mixing chamber such that chilled water is thoroughly mixed with the concentrate before the beverage is dispensed.

Referring to FIG. 4, we have there shown a typical pump module in considerable detail. Although we refer to this as module 44, it is to be understood that all three modules are substantially identical. The module is primarily supported from suspension holes 45*a*, located in mounting plate 45. The mounting plate 45 may be made of plastic or metal, and is attached to the aft part of the reduction gear unit 93. The holes 45*a* are typically engaged by a spaced pair of hook-like devices mounted on a bar (not shown) affixed to the frame, which extends in the left right direction across a mid part of the machine. The front of each module is preferably supported from the previously mentioned front support plate 43.

On the front plate 70 of the module 44, which is on the right hand side as viewed in this figure, the dispensing nozzle 14 is to be seen. Just above the nozzle on the front plate of the module are Brix adjustment screws, these involving screw 72, by means of which the rate of water flow to the mixing chamber 78 (see FIG. 5) is controlled. Also involved is adjusting screw 74, which makes it conveniently possible to adjust the flow rate of concentrate. Concentrate is supplied to the concentrate inlet fitting 55 shown in FIG. 4 by the tube 54, which is to be seen in FIG. 2. It is to be understood that tube 54 fits tightly over the fitting 55. During the operation of the concentrate pump 86, it draws in the concentrate entering fitting 55 through another tube, latter tube being on the far side of the module, and hence not visible in FIG. 4.

Figure 5:
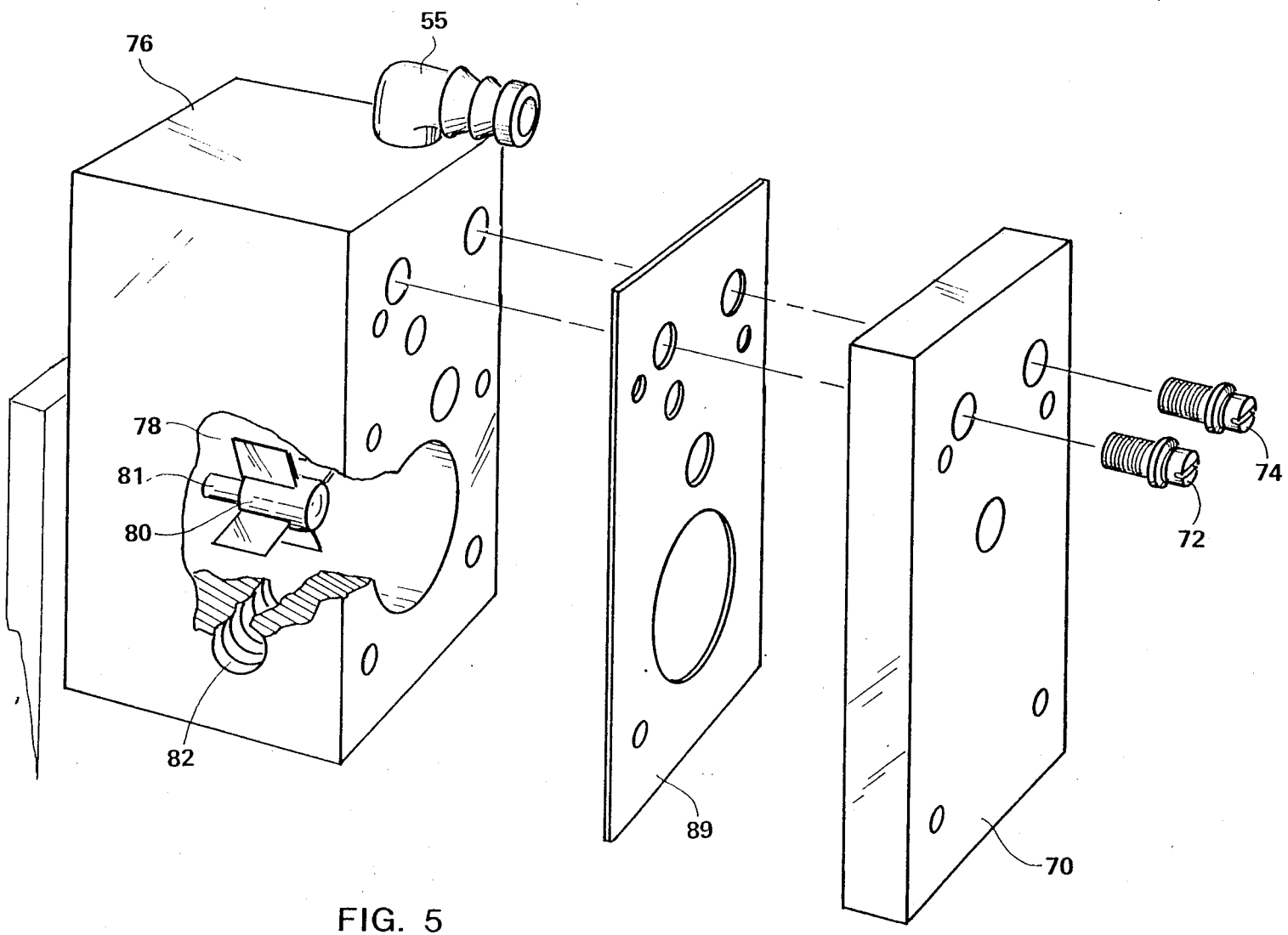
FIG. 5 is a view of the mixing chamber housing of the pump module, with the sidewall being sufficiently broken away to reveal internal construction.

Behind the front plate 70 is the housing 76, and it is in this housing that the mixing chamber 78 is located. FIG. 5 reveals this chamber in some detail, and shows the motor driven impeller 80 mounted upon shaft 81 therein. Also shown is a gasket 89 located between the front plate 70, and housing 76. The concentrate inlet port 82 shown in FIG. 5 enables concentrate to be delivered to the mixing chamber when dispensing from this module.

Returning to FIG. 4, a tube 84 leading from the pump 86, preferably a peristaltic pump, brings concentrate forward, and connects to an elbow 88 mounted in inlet port 82, in order that concentrate may reach the mixing chamber 78. The peristaltic pump is of known construction, and is not per se a vital aspect of this invention. The Benoun et al. U.S. Pat. No. 4,316,557 entitled "Beverage Dispenser with Removable Tank Connection Means" teaches the use of such a pump.

Figure 5A:
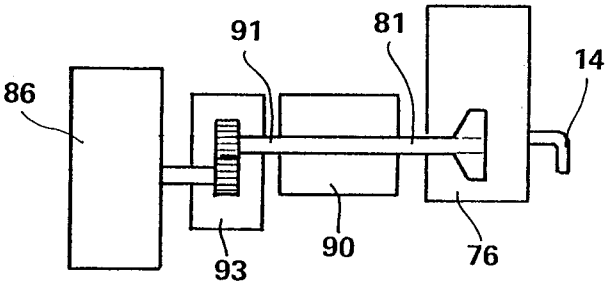
FIG. 5*a* is a simplified showing of a typical pump module, illustrating how the outputs of its dual output shafts are utilized.

The motor 90 utilized for driving the peristaltic pump 86 and the impeller 80 is disposed between the housing 76 and the pump. Unlike prior art arrangements in which the swirling action of entering water was relied upon to effect a proper dilution of the concentrate, we employ the impeller 80 to rotate at a sufficient speed that a very effective action is brought about. Our pump modules can be of minimal size and weight by utilizing both ends of the shaft of motor 90 in the manner indicated in FIG. 5*a*, of which is preferably of stainless steel. The forward motor shaft 81 drives the impeller 80, and the rearward shaft 91 drives the peristaltic pump 86, preferably through the reduction gear unit 93, previously mentioned. The axis of rotation of the pump is essentially horizontal, and advantageously, the pump is somewhat lower than the motor, hence any tubing rupture is unlikely to bring about the motor seizing up, as was prone to occur in certain prior art devices. The preferred motor arrangement is shown in FIG. 4, and schematically in FIG. 5*a*.

Also visible in FIG. 4 is the water solenoid 92 associated with this pump module. The elbow 94 connects to a hose (not shown) that in turn connects to the appropriate delivery outlet for chilled water from the water tank 32, and by proper operation of the solenoid, the correct amount of water is mixed with the cold concentrate flowing to the mixing chamber. As previously indicated, the preferred arrangement is for the solenoid 92 to be actuated by the respective dispensing button 16, such that the solenoid is permitting water to flow into the mixing chamber only during the time that the respective peristaltic pump is in operation. In that way, a freshly mixed cup or glass of juice is provided each time the selected dispensing button is pressed.

As is obvious, it may be necessary from time to time to adjust the quantities of concentrate and water being delivered to the mixing chamber 78. Suitable adjustments of these quantities are made possible by manipulation of the Brix adjustment screws 72 and 74, as mentioned hereinbefore. Typically, the screw 74 associated with the flow of concentrate is set at a suitable basic setting, with fine grain adjustments of the strength of the delivered beverage thereafter being made by suitable rotation of the screw 72.

Figure 6:
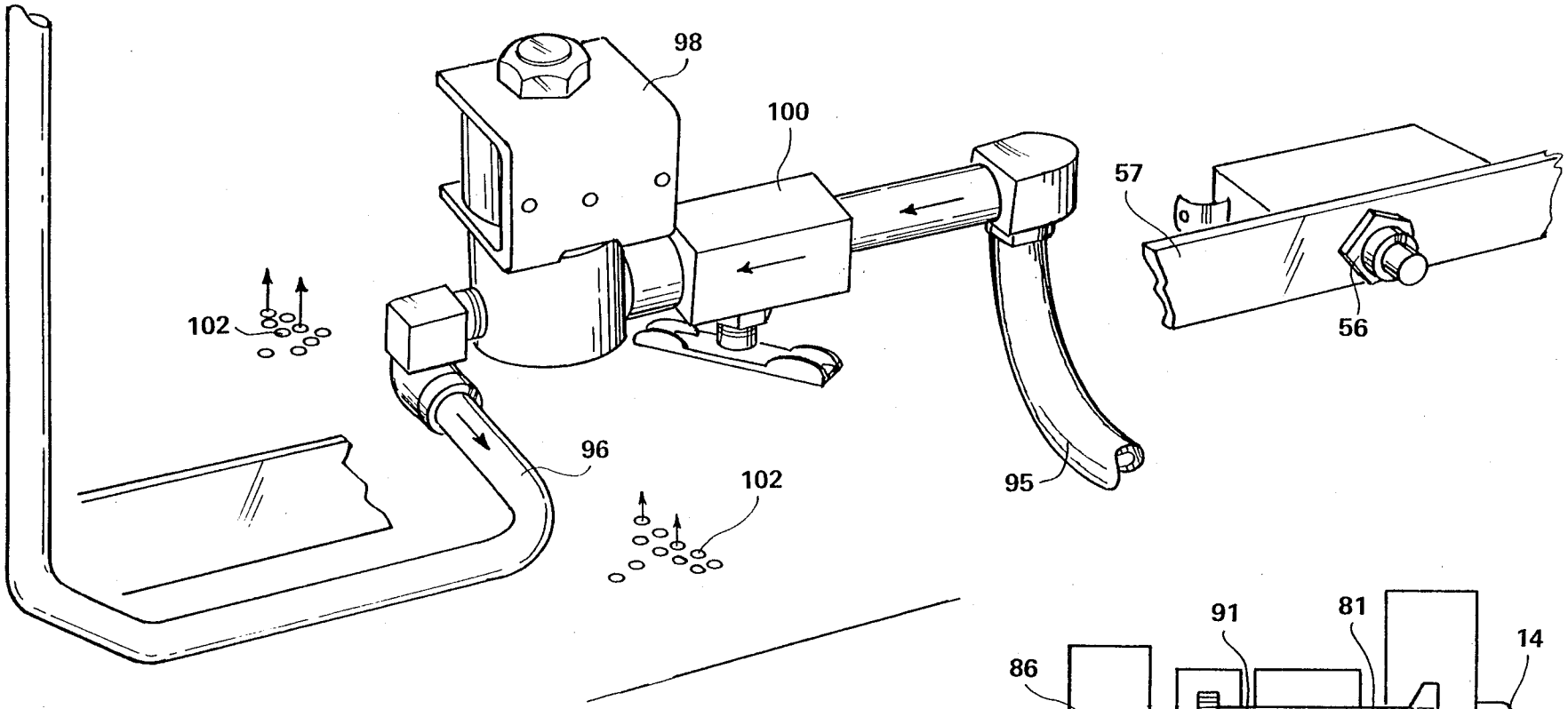
FIG. 6 is a fragmentary view of the water supply pipe and the solenoid and water shutoff valves used therein, as well as a showing of a typical electrical switch such as causes the operation of the respective pump motor when a beverage is to be dispensed.

Turning to FIG. 6, we have there shown a fragmentary portion of the water supply pipe 96, which connects to water inlet pipe 35. Disposed in this pipe is solenoid valve 98, which is operated by the proximity switch 40 such that the water tank 32 is kept filled to the proper level. Although any of a number of suitable solenoid valves would serve our purposes, we prefer one made by Deltrol of Milwaukee, Wis., preferably Model No. DSV 22-090-AO3A-B1.

For convenience, we provide a manually operated water shutoff valve 100, disposed in the water inlet line 95. This valve is closed off at such times as the dispenser is not to be used, or service work is to be performed.

Also visible in FIG. 6 is one of the push button electric switches 56, which is mounted on elongate mounting plate 57 directly in front of the valves 98 and 100. As should now be clear, upon a selected dispensing button 16 being pressed, the corresponding switch is actuated, causing the appropriate motor to run, bringing about the pumping of concentrate, and the mixing thereof in the mixing chamber with a suitable quantity of chilled water. The mixed beverage thereafter flows out of the respective dispensing nozzle 14 under the combined influence of gravity, and the centrifugal force brought about by the action of the impeller 80 of that mixing chamber.

Referring to FIG. 7, it will be seen that we have there illustrated a float device 104 of the type we prefer to employ in the tank 32, working in concert with the previously-described water inlet solenoid 98.

The float device 104 utilizes a pair of elongate rods 106 of non-corrosive material, such as of brass, stainless steel, or the like, which forms the support for a plastic tube 108, the ends of which have been plugged to prevent the entry of water. Consequently, the plastic tube 108 will move upwardly or downwardly in accordance with water level changes, with an encircling clamp 110 serving to assure the plastic tube remaining essentially erect, and parallel to the rods 106. The ends of the clamp 110 are sufficiently enlarged as to avoid binding on the rods.

Supported on the upper end of the plastic tube 108 is magnetic actuator 112, which contains a pair of holes through which the rods 106 extend. The magnetic actuator is arranged to interact with the fully enclosed and sealed proximity switch 40, previously mentioned in connection with the water tank cover 30. The magnetic actuator utilizes a plastic encapsulated piece of ferric metal, which aligns with the switch portion of the proximity switch unit when the water level in the tank is high. When the water has risen in the tank 32 to such a height that the magnetic actuator is within approximately three-eights of an inch of the switch 40, the magnetic actuator is pulled into touching contact with the switch 40, at which time the normally closed solenoid 98 shuts off the flow of water into the tank, due to the opening of its electrical circuit.

After some dispensing of beverage, the water level in the tank 32 will fall, causing the float tube 108 to lower, although the tube may not lower until the water level has moved down an inch or two. This slight delay may occur due to the attraction between the switch 40 and the magnetic actuator 112.

Referring to FIG. 8, we have there shown an electrical schematic of the principal components and circuits of our machine, with 110 volt A.C. power being supplied to terminal board 29 by means of electrical cord 27. One side of the line carried in electrical cord 27 is connected via terminal board 29 to lead 33, for convenience called the positive lead 33. This lead provides power to the main service on-off switch 41, and when this switch is in the "on" position, it in turn supplies electrical power to to the lead 67 connected to the several push button switches 56. Inasmuch as we prefer to use three modules, which are modules 44, 46, and 48, we of course use three switches 56. Because the switch 41 is preferably placed behind a panel requiring a key for access, as previously mentioned, theft of concentrate or mixed beverage during non-work hours can be largely prevented.

The main service switch 41 preferably is not connected so as to control electric power to the compressor and fan, for we prefer to have the refrigeration system continue to operate, even while power to the pump modules has been interrupted for maintenance or repair efforts. If desired to work on the refrigeration system, or the water level controlling devices, which likewise are not supplied with electricity through the switch 41, it is but a simple pull to the power cord 27 out of its wall receptacle.

As should now be clear, the proximity switch 40 controls the application of electrical power to the incoming water solenoid valve 98, such that proper quantities of water are admitted to the tank 32, as needed to replenish water used to mix with the concentrate. The thermostat 63*a* controls the running of the compressor 64, such that the water in the tank 32 and the concentrate in the tanks 34, 36 and 38 are chilled to a desired temperature.

It was also explained that the pressing of a selected dispensing button 16 causes the respective switch 56 to be closed, with this resulting in the application of electrical power to the corresponding pump motor 90, and to the corresponding water solenoid 92, such that the respective pump 86 is driven in rotation, and a proper amount of water is mixed therewith, as a result of the opening of the solenoid 92. The pump motor stops, and the corresponding solenoid 92 closes when the push button is released.

The circuit through these several components is completed by the use of a lead connected to the other side of the line, for convenience called negative lead 68, which connects back to the negative terminal of the terminal board 29, which in turn connects to the other side of the line contained in the power cord 27.

We claim:

1. A machine for dispensing a freshly mixed cup of juice or other beverage made from concentrate mixed with water immediately prior to the dispensing, comprising a water reservoir, means attached to a water source for keeping an approximately constant head of water in said reservoir at all times, refrigeration coils disposed in the interior of said reservoir, and connected to means for causing the circulation of refrigerant through said coils, thus to chill the water to a temperature above the freezing point, at least one concentrate tank disposed closely adjacent said reservoir, with said refrigeration coils serving to keep the concentrate chilled, an electric pump connected to deliver concentrate from said concentrate tank to a mixing chamber, said pump having operator controlled actuating means, such that an operator can selectively cause a controllable quantity of concentrate to be delivered to said mixing chamber, water connection means from said reservoir to said mixing chamber, a power driven impeller located in said mixing chamber, with said impeller serving to mix such concentrate with a suitable quantity of water from said reservoir, adjustment means enabling the amounts of water and concentrate to be altered slightly from time to time as may be necessary to assure a selected ratio of these ingredients being maintained, and outlet means connected to said mixing chamber so that the properly mixed beverage can be dispensed into a cup or other drinking receptacle.

2. The machine for dispensing juice as recited in claim 1 in which the flow of water from said reservoir to said mixing chamber is controlled by a solenoid, and means for actuating said solenoid to permit the flow of water into said mixing chamber only during the time said pump is operating.

3. The machine for dispensing juice as recited in claim 1 in which said pump is a peristaltic pump.

4. The machine for dispensing juice as recited in claim 1 in which a plurality of concentrate tanks are utilized, and a separate mixing chamber is operably associated with each concentrate tank.

5. The machine for dispensing juice as recited in claim 1 in which said means for keeping an approximately constant head of water in said reservoir includes the use of a proximity switch arranged to operate a water supply solenoid.

6. A machine for dispensing a freshly mixed cup of juice or other beverage made from concentrate mixed with water immediately prior to the dispensing, comprising a water reservoir, means attached to a water source for keeping an approximately constant head of water in said reservoir at all times, refrigeration coils disposed in the interior of said reservoir, and connected to means for causing the circulation of refrigerant through said coils, thus to chill the water to a temperature above the freezing point, at least one concentrate tank disposed closely adjacent said reservoir, with said refrigeration coils serving to keep the concentrate chilled, an electric pump connected to deliver concentrate from said concentrate tank to a mixing chamber, said pump having operator controlled actuating means, such that an operator can selectively cause a controllable quantity of concentrate to be delivered to said mixing chamber, water connection means from said reservoir to said mixing chamber, a power driven impeller located in said mixing chamber, with said impeller serving to mix such concentrate with a suitable quantity of water from said reservoir, and outlet means connected to said mixing chamber so that the properly mixed beverage can be dispensed into a cup, and a single motor which drives both said pump and said impeller.

7. The machine for dispensing juice as recited in claim 6 in which said motor, said pump, said solenoid and said mixing chamber form a modular unit that can be readily serviced or replaced.

8. The machine for dispensing juice as recited in claim 6 in which said concentrate tank is utilized in concert with a motor, pump, and mixing chamber, thus forming a modular unit that can be readily serviced or replaced.

9. A machine for dispensing a freshly mixed cup of juice or other beverage made from concentrate mixed with water immediately prior to the dispensing, comprising a water reservoir, means attached to a water source for keeping an approximately constant head of water in said reservoir at all times, refrigeration coils disposed in the interior of said reservoir, and connected to means for causing the circulation of refrigerant through said coils, thus to chill the water to a temperature above the freezing point, said water reservoir being generally U-shaped, and said refrigeration coils being disposed generally in a U-shaped configuration, so as to extend to substantially all interior parts of said U-shaped reservoir, at least one concentrate tank disposed closely adjacent said reservoir, with said refrigeration coils serving to keep the concentrate chilled, an electric pump connected to deliver concentrate from said concentrate tank to a mixing chamber, said pump having operator controlled actuating means, such that an operator can selectively cause a controllable quantity of concentrate to be delivered to said mixing chamber, water connection means from said reservoir to said mixing chamber, a power driven impeller located in said mixing chamber, with said impeller serving to mix such concentrate with a suitable quantity of water from said reservoir, and outlet means connected to said mixing chamber so that the properly mixed beverage can be dispensed into a cup.

10. The machine for dispensing juice as recited in claim 9 in which said reservoir has a spaced pair of arms, and a shelf is formed between said arms, upon which shelf, said concentrate tanks are removably mounted.

11. A machine for dispensing a freshly mixed cup of juice or other beverage made from concentrate mixed with water immediately prior of the dispensing, comprising a water reservoir, means attached to a water source for keeping an approximately constant head of water in said reservoir at all times, refrigeration coils disposed in the interior of said reservoir, and connected to means for causing the circulation of refrigerant through said coils, thus to chill the water to a temperature above the freezing point, at least one concentrate tank disposed closely adjacent said reservoir, with said refrigeration coils serving to keep the concentrate chilled, an electric pump connected to deliver concentrate from said concentrate tank to a mixing chamber, said pump having operator controlled actuating means, such that an operator can selectively cause a controllable quantity of concentrate to be delivered to said mixing chamber, water connection means from said reservoir to said mixing chamber, a power driven impeller located in said mixing chamber, with said impeller serving to mix such concentrate with a suitable quantity of water from said reservoir, and outlet means connected to said mixing chamber so that the properly mixed beverage can be dispensed into a cup, said refrigeration coils being the evaporator portion of a modular refrigeration system that also includes a compressor and condensor, said refrigeration system being readily removable as a modular unit from said machine, for repair or service.

12. A machine for dispensing a freshly mixed cup of juice or other beverage made from concentrate mixed with water immediately prior to the dispensing, comprising a water reservoir involving a central portion, and a pair of spaced arms extending essentially horizontally outwardly therefrom, thus to define a reservoir of generally U-shaped configuration, means attached to a water source for keeping an approximately constant head of water in said reservoir at all times, refrigeration coils disposed in the interior of said U-shaped reservoir, and connected to means for causing the circulation of refrigerant through said coils, thus to chill the water to a temperature above the freezing point, at least one concentrate tank disposed between the arms of said reservoir, with said refrigeration coils serving to keep the concentrate chilled, as electric pump having operator controlled actuating means, connected to deliver a controllable quantity of concentrate from said concentrate tank to a mixing chamber, upon said actuating means being operated, water connection means from said reservoir to said mixing chamber, means for mixing concentrate with a controllable quantity of water from said reservoir in said mixing chamber, and outlet means connected to said mixing chamber so that the properly mixed beverage can be dispensed into a cup.

13. The machine for dispensing juice as recited in claim 12 in which a power driven impeller is utilized in said mixing chamber as said means for mixing, with a single motor driving both sad pump and said impeller.

14. The machine for dispensing juice as recited in claim 12 in which the flow of water from said reservoir to said mixing chamber is controlled by a solenoid, and means for actuating said solenoid to permit the flow of water into said mixing chamber only during the time said pump is operating.

15. The machine for dispensing juice as recited in claim 12 in which said motor, said pump, and said mixing chamber, form a modular unit that can be readily repaired or replaced.

16. The machine for dispensing juice as recited in claim 12 in which said concentrate tank is utilized in concert with a motor, pump, and mixing chamber, thus forming a modular unit that can be readily repaired or replaced.

17. The machine for dispensing juice as recited in claim 12 in which said pump is a peristaltic pump.

18. The machine for dispensing juice as recited in claim 12 in which a plurality of concentrate tanks are utilized, and a separate mixing chamber is operably associated with each concentrate tank.

19. The machine for dispensing juice as recited in claim 12 in which said refrigeration coils are generally in a U-shaped configuration, so as to extend to substantially all interior portions of said U-shaped reservoir.

20. The machine for dispensing juice as recited in claim 12 in which a shelf is formed between the arms of said U-shaped reservoir, upon which shelf, said concentrate tanks are removably mounted.

21. The machine for dispensing juice as recited in claim 12 in which said means for keeping an approximately constant head of water in said reservoir includes the use of a proximity switch.

22. The machine for dispensing juice as recited in claim 12 in which said refrigeration coils are the evaporator portion of a modular refrigeration system that includes a compressor and condenser, said refrigeration system being readily removed for repair from said machine, as a modular unit.

23. A machine for dispensing a freshly mixed cup of juice or other beverage made from concentrate mixed with water immediately prior to the dispensing, comprising a housing having a front opening, a water reservoir equipped with forwardly extending arms, disposed in an upper portion of said housing, refrigeration means for keeping the water in said reservoir chilled to a temperature above the freezing point, at least one readily removable concentrate tank disposed closely adjacent said reservoir and between said arms, with said refrigeration means also serving to keep the concentrate chilled, pump means for delivering concentrate from said concentrate tank to an adjacent mixing chamber, means for mixing water from said reservoir with such concentrate in said mixing chamber in the proper proportion, and outlet means connected to said mixing chamber so that the properly mixed beverage can be dispensed into a cup, said concentrate tank being readily accessible through said front opening of said housing.

24. The machine for dispensing juice as recited in claim 23 in which individual adjustment means accessible through said front opening are available for precisely adjusting the amounts of concentrate and water entering said mixing chamber during the dispensing of juice, so that a proper ratio of ingredients can at all times be assured.

25. The machine for dispensing juice as recited in claim 23 in which a plurality of concentrate tanks are utilized in a side-by-side relation, with each tank having its respective pump means and mixing chamber, each tank in concert with its pump and mixing chamber forming a modular unit that can be readily removed from said housing for cleaning or repair.

26. The machine for dispensing juice as recited in claim 23 in which said means for mixing water with concentrate in said mixing chamber is a power driven impeller, said machine having motor means for driving said pump means and said impeller, and activating means under the control of the operator for bringing about the operation of said motor means, so as to cause the dispensing of freshly-mixed juice on an as-needed basis.

27. The machine for dispensing juice as recited in claim 23 in which means for maintaining a constant water level are utilized in connection with said reservoir, such that the chilled water delivered to the mixing chamber is always in a predictable quantity, with the concentrate delivered by said pump to said mixing chamber likewise being in a predictable quantity, with these properly proportioned ingredients then being mixed in said mixing chamber by said mixing means into a homogenous, palatable drink.

28. A machine for consistently dispensing a freshly mixed cup of juice or other beverage made from concentrate mixed with a preselectd, optimum quantity of water immediately prior to the dispensing, cmprising a water reservoir, means attached to a water source for keeping an approximately constant head of water in said reservoir at all times, refrigeration means for chilling the water in said reservoir to a temperature above the freezing point, at least one concentrate tank disposed closely adjacent said reservoir, with said refrigeration means serving to keep the concentrate chilled, a mixing chamber in which concentrate can be mixed with water, means forming a connection between said water reservoir and said mixing chamber, and utilizing therein an electrically controlled valve for controlling the flow of water from said reservoir to said mixing chamber, means forming a connection from said concentrate tank to said mixing chamber, in which connection is disposed an electrically powered pump for delivering concentrate from said concentrate tank to said mixing chamber, said pump and said electrically controlled valve being under the control of a dispensing device, such that an operator can cause a consistent quantity of concentrate and water to be delivered to said mixing chamber each time the dispensing device is actuated, a power driven impeller located in said mixing chamber, with said impeller serving to mix such concentrate with a suitable quantity of water from said reservoir, adjustment means for enabling precise, minute adjustment of quantities of concentrate and water to be made as may be necessary from time to time in order to assure a correct ratio of water to concentrate, and outlet means connected to said mixing chamber so that an essentially homogeneous mixture of water and concentrate can be dispensed.

29. The machine for consistently dispensing a freshly mixed cup of juice or other beverage as recited in claim 28 wherein a plurality of concentrate tanks are utilized in a side by side relationship, with each tank having its own respective pump means and mixing chamber, each tank in concert with its pump and mixing chamber forming a modular unit that can be readily removed from said housing for cleaning or repair.

30. The machine for consistently dispensing a freshly mixed cup of juice or other beverage as recited in claim 28 wherein said machine has electric motor means for driving said pump means and said impeller, with the operation of said dispensing device by the operator bringing about the operation of said motor means, so as to cause the dispensing of freshly-mixed juice on an as-needed basis.

31. The machine for consistently dispensing a freshly mixed cup of juice or other beverage as recited in claim 30 in which a single motor means drives both said impeller and said pump means for delivering concentrate.

32. The machine for dispensing juice as recited in claim 28 in which said means for keeping an approximately constant head of water in said reservoir assures that the chilled water delivered to said mixing chamber is always in a predictable quantity, with the concentrate delivered by said electrically powered pump to said mixing chamber likewise being in a predictable quantity, with these properly proportioned ingredients then being mixed in said mixing chamber by said power driven impeller into a homogeneous, palatable drink.

* * * * *